United States Patent [19]

Spalding et al.

[11] Patent Number: 5,075,664

[45] Date of Patent: Dec. 24, 1991

[54] SPRING TIMER FOR FUSE

[75] Inventors: Keith A. Spalding, Fenton; Fred Levko, Chesterfield , both of Mo.

[73] Assignee: Cooper Industries, Inc., Houston, Tex.

[21] Appl. No.: 406,162

[22] Filed: Sep. 12, 1989

[51] Int. Cl.[5] ..... H01H 85/04

[52] U.S. Cl. ..... 337/164; 337/165

[58] Field of Search ..... 337/163, 164, 165, 166

[56] References Cited

U.S. PATENT DOCUMENTS 3,342,964 9/1967 Kozacka ..... 337/164

4,344,058 8/1982 Knapp, Jr. et al. ..... 337/244

*Primary Examiner*—Harold Broome

*Attorney, Agent, or Firm*—Donald Verplancken; Ned L. Conley; David A. Rose

[57] ABSTRACT

A trigger for a dual element time delay fuse includes a paper cap and a heater strip having locating ears thereon.

12 Claims, 3 Drawing Sheets

SPRING TIMER FOR FUSE

BACKGROUND OF THE INVENTION

This invention relates to the field of fuse triggering devices, more particularly triggering devices employed in time delay dual element cartridge fuses capable of interrupting circuits under both overload and short circuit conditions.

Time delay fuses include a short circuit element projecting from a spring trigger mechanism to form a fusing assembly, which is then held in an insulated tube and mechanically and electrically connected to opposed end ferrules. A time delay low voltage cartridge fuse of this type is disclosed in U.S. Pat. No. 4,344,058, Knapp, Jr., et al.

The short circuit strip is anchored to the spring trigger mechanism through a spring loaded bullet member. The bullet member is a cold headed part and extends outward from a barrel having a spring therein to bias the bullet toward re-entry of the barrel. An open ended paper sleeve surrounds the barrel, and the open end of the barrel opposite the bullet is covered with a barrel plug which is received in an inner radial lip therein. The barrel also has an outer radial flange on its open end adjacent the inner radial lip. This flange is used to position the open ended paper sleeve thereon. The paper sleeve is assembled over the barrel and biased to abut the flange. The paper sleeve insulates the heater strip, which carries current from one end of the fuse, from contact with the barrel. Since the sleeve is assembled to abut against the outer radial flange, and the heater strip is soldered to the end of the bullet and extends over the paper sleeve, the paper sleeve must be assembled to the barrel before the heater strip is soldered to the bullet.

To close off the end of the trigger, an insulating washer is located over a barrel plug, which in turn is disposed in the trigger barrel opposite the bullet and retained in a radial groove therein. The barrel plug helps isolate the inside of the trigger from arc quenching filler disposed within the fuse. The washer is disposed over the barrel plug and end of the barrel to isolate the barrel from the end ferrule. To mechanically and electrically link the heater strip, bullet and short circuit element, a fusing alloy is disposed at the juncture of the bullet and barrel, heater strip and short circuit element. The fusing alloy is a low melting point solder designed to melt when the heat given off by the heater strip from a long term overload condition elevates its temperature to the melting point. Upon assembly of this sub-assembly into the insulating tube, the heater strip is folded over the side of the barrel and then over the edge of the tube, and a ferrule is fitted over the end, creating an electrical path therebetween.

To quench any electrical arcing which arises after the short circuit element melts, or as the trigger pulls away from the short circuit element, some prior art fuses are packed with arc quenching fillers such as sand. The washer and barrel plug are used to prevent entry of sand into the rear trigger mechanism, and the bullet portion is tapered to allow a minimum space between it and the barrel when the fuse is in the closed position, which helps prevent jamming of the trigger with the filler as the trigger opens. The sand surrounds both the trigger and short circuit strip elements of the fuse.

In operation, the fuse will open under two types of conditions. If an electrical short circuit is encountered, the heat produced in the short circuit element, which is caused by the passage of excess electric current through the necked down portions thereof, causes the short circuit element to melt, opening the circuit across the opposed end ferrules of the fuse. Under long term overload conditions, the electric current flowing through the heater strip generates heat, and after a sufficient period of time the heat will cause the fusing alloy to melt. This causes the spring to retract the bullet into the barrel, thus causing the bullet to pull away from the short circuit element, opening the circuit through the fuse.

In the prior art designs, the spring loaded trigger is a complex and a costly design. The barrel is made on a screw machine, to include the inner radial lip to retain the plug and an outer flange to locate the paper sleeve. The fuse plug and paper sleeve must be separately located onto the barrel, and the washer must be placed over the trigger, before the ferrule is loaded over the end of the tube.

SUMMARY OF THE INVENTION

The improved trigger has a barrel for receiving a spring loaded bullet therein, and an insulated end cap having an integral end or cover disposed over the barrel to cover the circumferential outer surface and open end of the barrel opposite the bullet. A heater strip is disposed over the outer circumferential surface of the end cap which is then disposed in one end of an insulated tube. The heater strip includes ears which preferably contact the inner surface of the fuse tube to help center the trigger therein.

By employing a sleeve having an integral end cap, the barrel plug and washer are eliminated, thereby reducing the number of parts in the assembly. Further, by eliminating the barrel plug, the need for the plug lip in the barrel is eliminated. Further, the outer flange at the end of the barrel is eliminated. This permits manufacture of the trigger through relatively inexpensive stamping as opposed to screw machine turning.

The elimination of the flange on the end of the barrel also allows for assembly of the paper sleeve after the solder juncture between the trigger and the short circuit and heater strips is made. This results in easier soldering of these elements, with resultant reduced labor and fixuring costs, because the risk of burning the sleeve is eliminated. As a result, the assembly of the fuse is easily semi-automated.

The ears permit the easy centering of the trigger in the tube, and the ears help maintain the trigger longitudinally in the tube during final assembly.

BRIEF DESCRIPTION OF THE DRAWINGS

The above and other objects and advantages of the invention will become apparent from the accompanying description when read in conjunction with the following drawings wherein.

BRIEF DESCRIPTION OF THE PREFERRED EMBODIMENT

Figure 1:
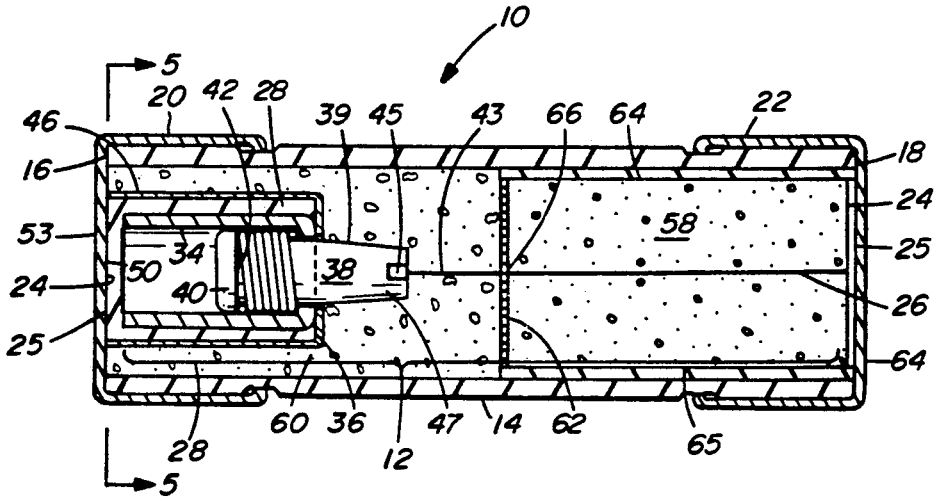
FIG. 1 is a cross-sectional view of the trigger in the unopened condition.
Figure 2:
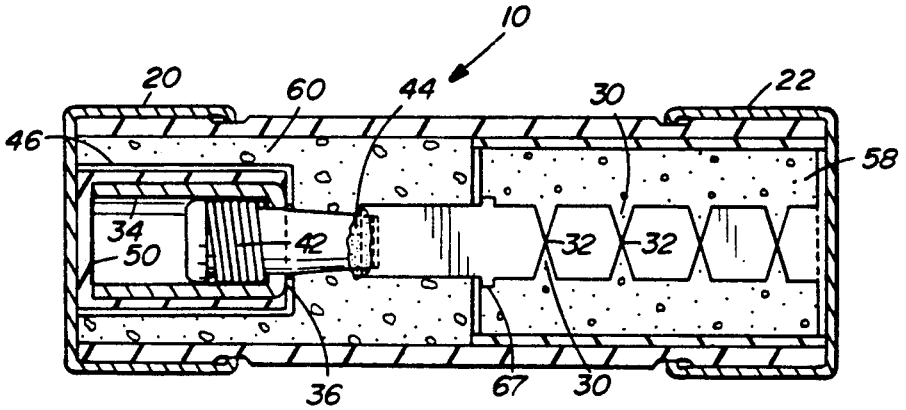
FIG. 2 is a second cross-sectional view of the trigger of FIG. 1 in the unopened position and rotated 90 degrees.
Figure 3:
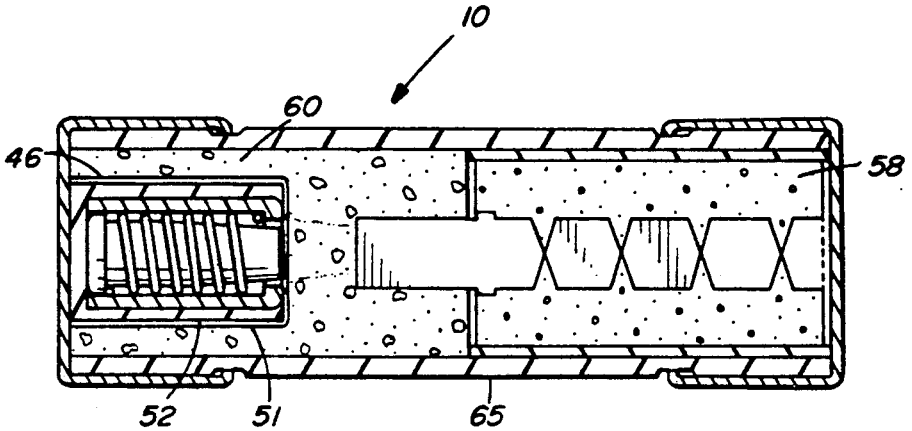
FIG. 3 is a cross-sectional view of the trigger of FIG. 2 following a long term circuit overload, triggering the spring trigger to open the fuse.
Figure 4:
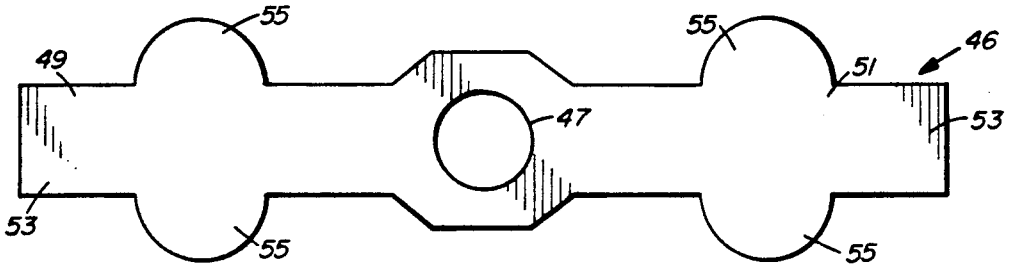
FIG. 4 is a plan view of the heater strip prior to assembly thereof on the trigger of FIG. 1.
Figure 5:
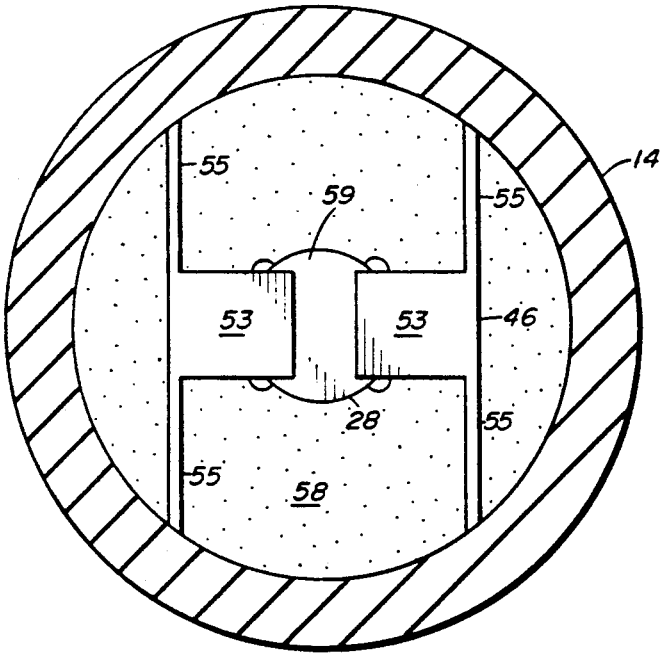
FIG. 5 is an end view of the trigger of FIG. 1.

Referring to FIGS. 1 to 3, trigger assembly 28 is shown mounted in fuse tube 14. Fuse tube 14 includes opposed end ferrules 20 and 22 mounted thereon, and a short circuit strip 26 extending from ferrule 22 inward the tube 14. The combination of the trigger assembly 28 and short circuit strip 26 in tube 14 with opposed ferrules 20 and 22 forms a dual element time delay fuse. The short circuit strip 26 opens the fuse in response to high instantaneous current whereas the trigger assembly 28 opens the fuse in response to long term current overload. Dual element time delay fuses using trigger mechanisms and short circuit strips are well known in the art.

Trigger assembly 28 includes a metallic barrel 34 having a flange thereon 36 and a bullet 38 which extends outward from barrel 34. Barrel 34 and bullet 38 are preferably made of brass, although other metallic materials could be used without deviating from the scope of the invention. Bullet 38 includes a spring retainer lip 40 projecting radially outward at the end thereof received within barrel 34. A spring 42 is disposed against and between spring retainer lip 40 and flange 36. Bullet 38 extends outward from flange 36 and is connected to lead 43 of a short circuit strip 26 through a coating of fusing alloy 44. To help position lead 43 with respect to bullet 38, an alignment slot 45 is disposed in the end 47 of bullet 38 and lead 43 is received therein. Bullet 38 has a tapered outer surface 39, such that its diameter adjacent the spring retainer lip 40 is greater than its diameter adjacent the barrel flange 36. Therefore, in the fully extended bullet 38 position shown in FIG. 1, the space between the side of the bullet 38 and the flange 36 is minimized. Bullet 38 and lead 43 are bonded together with fusing alloy 44, which juncture provides a force to maintain bullet 38 in position to compress spring 42. To further help maintain spring 42 in compression between flange 36 and lip 40, a bead of fusing alloy 44 is placed circumferentially about the flange 36-bullet 38 interface with the lip 40 of bullet 38 fully compressing spring 42 against flange 36. When trigger 28 opens, as shown in FIG. 3, fusing alloy 44 melts and the taper of the bullet 38 helps assure that barrel 34 and bullet 38 do not interfere, which would prevent opening of the fuse trigger. Fusing alloy 44 is a lead-tin-bismuth solder having a low melting point which will melt when a long term overload condition exists.

Referring to FIGS. 1 through 7, spring trigger assembly 28 further includes heater strip 46, which is bent over insulative cap 50 adjacent ferrule 22. Heater strip 46 is a strip of resistance metal, which generates heat when an electrical current is passed therethrough. The cross section of heater strip 46 is sized to generate little heat during normal conditions, i.e. the passage of rated fuse current, but will generate sufficient heat when exposed to about 135% to about 500% of rated current to melt fusing alloy 44 according to predetermined timing. Heater strip 46 includes bullet retainer 47, which is a circular cutout through the center thereof, and a pair of opposed, preferably flaps 49 and 51 radiating outward therefrom. Each flap 49 and 51 includes a contact end 53 and opposed, preferably semicircular ears 55 disposed between end 53 and retainer 47. Ears 55 may be other than semicircular, e.g., triangular, rectangular, or other polygon-shaped. To obtain electrical engagement between short circuit strip 26 and heater strip 46, bullet retainer 47 with bullet 38 projecting therethrough, and heater strip 46 are disposed in fusing alloy 44 adjacent the bullet 38-flange 36 interface of spring trigger assembly 28. As bullet 38 is comprised of metal, an electrical circuit is created from heater strip 46, through fusing alloy 44 and bullet 38, and into lead 43.

Figure 6:
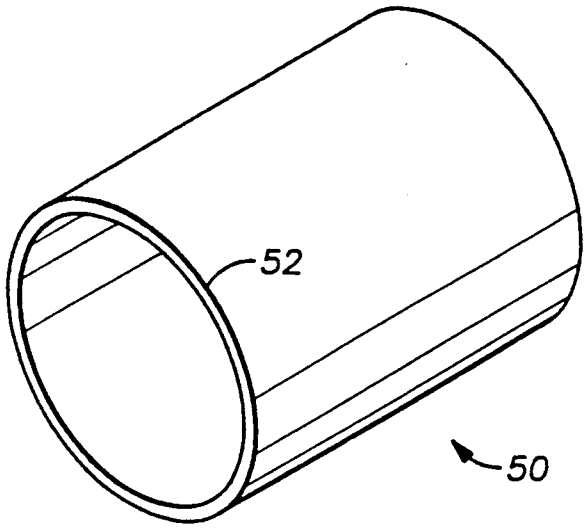
FIG. 6 is a perspective view of the paper cap of the trigger of FIG. 1.
Figure 7:
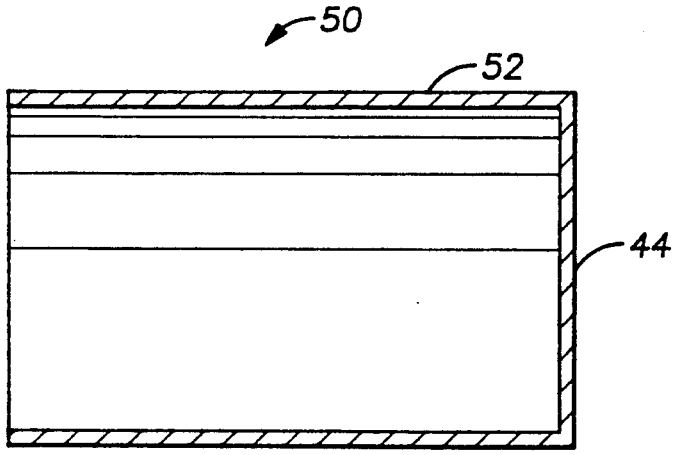
FIG. 7 is a cross-sectional view of the paper cap of FIG. 6.

Insulative cap 50, best shown in FIGS. 1, 6 and 7, having cylindrical body 52 surrounding the outer circumference of barrel 34 and integral end cover 54 disposed over the open end of barrel 34 opposite bullet 38, seals the interior of barrel 34 from the remainder of the area inside the tube 14. Cap 50 may be manufactured from various materials, including wood, plastic, kraft paper, vulcanized fiber or other insulative materials. As cap 50 is not placed upon the end of the trigger 28 until after the soldering of the short circuit strip 26 and heater strip 46 to the bullet 38 is accomplished, materials which would melt in the presence of soldering temperatures may be employed in the sleeve 50.

Heater strip 46 is disposed over cap 50 such that bullet 38 is received through bullet retainer 47 and opposed flaps are wrapped over the circumferential body 52 of cap 50. The positioning of ends 53 over end cover 54 places ends 53 in place to engage interior flat end surface 24 of ferrule 22. Ends 53 are preferably rectangular and are folded over end cover 54, and ears 55 thus extend outward to lie tangentially to the outer circumferential body 52 to engage the inner surface of tube 14 and position trigger 28 in tube 14. It is contemplated that the ears 55 may be bent to lie at different angles, such as perpendicular, to body 52. It is contemplated that there may be some spring action of the ears against the inner surface of the tube.

Trigger assembly 28 is surrounded by arc quenching fillers 58, typically loose fine sand. The use of arc quenching fillers 58 in dual element fuses is well known in the art. By using cap 50 to surround trigger assembly 28, the arc quenching fillers are prevented from migrating into the trigger which could cause the fuse to jam, rendering the fuse inoperative.

To obtain an electrical connection between ferrule 22 and heater strip 46, the end 53 of heater strip is folded over the top 54 of cap 50 and ferrule 22 is located over the end of tube 18 and heated. This heating causes the solder coating 25 to reflow. The heat is removed, and the solder hardens and ends 53 and end cap 22 are electrically and mechanically interconnected. Likewise, the end of short circuit strip 26 and ferrule 20 are electrically interconnected in solder coating 25 on the inner surface of ferrule 20. The use of ears 55 on heater strip 46 creates an interference between the trigger 28 and the inner wall of tube 14, which centers trigger 28 in tube 14 and helps maintain the ends 53 of heater strip 46 in engagement with the inside of end cap 22 to help assure a good solder connection 25 therebetween.

Referring to FIG. 3, trigger 28 is shown in the open position following a long term overload condition. The long term overload causes the heater strip 46 to generate heat, which raises the fusing alloy 44 to its melting temperature thereby melting the interface between the short circuit strip 26 and bullet 38, between bullet 38 and flange 36 and between heater strip 46 and bullet 38, causing spring 42 to actuate bullet 38 within barrel 34 from short circuit strip 26 to open the circuit between ferrules 20 and 22.

We claim:

1. A trigger for a false, comprising, a barrel member having opposed open ends and an outer perimeter;

a spring loaded bullet disposed within said barrel and projecting outward from one of said ends of said barrel member;

a one piece insulative cap member having a cap end portion and a tubular sleeve portion mounted on said barrel sealing said outer perimeter and said open end thereof opposite said bullet; and a heater strip extending from said bullet and extending over said cap member sleeve and end portions;

said bullet and heater strip mechanically and electrically interconnected in a fusing alloy.

2. The trigger of claim 1 wherein said bullet includes a spring retainer flange disposed radially about said end thereof disposed within said barrel;

said barrel including a lip projecting inward at said open end adjacent said bullet; and, a spring disposed between said flange and said lip.

3. The trigger of claim 1 wherein said cap member is manufactured from plastic.

4. The trigger of claim 1 wherein said cap member is manufactured of paper.

5. The trigger of claim 1 wherein said cap member is manufactured of vulcanized fiber.

6. The trigger of claim 1 wherein said cap member is manufactured of kraft paper.

7. The trigger of claim 1 wherein said heater strip includes locating ears projecting therefrom.

8. The trigger of claim 1 disposed in a fuse tube including arc quenching fillers.

9. The trigger of claim 8 wherein said arc quenching fillers are loose sand.

10. The trigger of claim 1 wherein the heater strip interconnects with a ferrule between the insulative cap and the inner surface of the flat end of the ferrule.

11. The trigger of claim 7, wherein said ears project tangentially from said insulative cap member.

12. The trigger of claim 7, wherein said ears project normal to said insulative cap member.

* * * * *